US008519940B2

(12) United States Patent
Yeo et al.

(10) Patent No.: US 8,519,940 B2
(45) Date of Patent: Aug. 27, 2013

(54) DISPLAY APPARATUS CAPABLE OF CHANGING DIMMING FREQUENCY OF BACK LIGHT AND CONTROL METHOD THEREOF

(75) Inventors: Dong-Hyun Yeo, Goyang-si (KR); Jae-Hyoung Park, Asan-si (KR); Byung-Kil Jeon, Anyang-si (KR)

(73) Assignee: Samsung Display Co., Ltd., Yongin (KR)

( * ) Notice: Subject to any disclaimer, the term of this patent is extended or adjusted under 35 U.S.C. 154(b) by 429 days.

(21) Appl. No.: 12/482,027

(22) Filed: Jun. 10, 2009

(65) Prior Publication Data

US 2010/0156866 A1 Jun. 24, 2010

(30) Foreign Application Priority Data

Dec. 24, 2008 (KR) ..... 10-2008-0133683

(51) Int. Cl.
*G09G 3/36* (2006.01)

(52) U.S. Cl.
USPC ..... 345/102; 345/208

(58) Field of Classification Search
USPC ..... 345/102, 208, 690, 691
See application file for complete search history.

(56) References Cited

U.S. PATENT DOCUMENTS

| | | | | |
|---|---|---|---|---|
| 6,008,791 | A | 12/1999 | Arai et al. | |
| 7,256,762 | B2 | 8/2007 | Yang et al. | |
| 7,675,578 | B2 | 3/2010 | Wang et al. | |
| 7,746,330 | B2 | 6/2010 | Yu et al. | |
| 8,139,019 | B2 | 3/2012 | Han et al. | |
| 2006/0125775 | A1* | 6/2006 | Itoh | 345/102 |
| 2007/0146295 | A1* | 6/2007 | Yu et al. | 345/102 |
| 2007/0257869 | A1* | 11/2007 | Huang et al. | 345/82 |
| 2008/0030615 | A1* | 2/2008 | Vasquez et al. | 348/446 |
| 2008/0033678 | A1* | 2/2008 | Bachhuber et al. | 702/89 |
| 2008/0062105 | A1* | 3/2008 | Han et al. | 345/90 |
| 2008/0143695 | A1* | 6/2008 | Juenemann et al. | 345/204 |
| 2008/0143757 | A1* | 6/2008 | Furihata et al. | 345/690 |

FOREIGN PATENT DOCUMENTS

| | | |
|---|---|---|
| CN | 1932947 | 3/2007 |
| JP | 2001-134244 | 5/2001 |
| JP | 2003-167545 | 6/2003 |
| JP | 2004-258668 | 9/2004 |
| JP | 2005338786 | 12/2005 |
| JP | 2006-238434 | 9/2006 |
| JP | 2008-070592 | 3/2008 |
| KR | 1020030075626 | 9/2003 |
| KR | 1020070092533 | 9/2007 |
| KR | 1020080090676 | 10/2008 |

OTHER PUBLICATIONS

The extended European search report of Mar. 2, 2011 in corresponding European Patent Application No. 09009319.6.

* cited by examiner

*Primary Examiner* — Chanh Nguyen
*Assistant Examiner* — Jonathan Blancha
(74) *Attorney, Agent, or Firm* — H.C. Park & Associates, PLC

(57) ABSTRACT

The present invention relates to a display apparatus to synchronize a synchronous signal and an inverter driving signal in response to a display mode, and a control method thereof. A back light unit of the display apparatus makes a back light to dim based on an inverter driving signal, and a dimming frequency of the back light varies in response to a synchronous signal frequency of the image. When a synchronous signal having an abnormal frequency is inputted to the back light unit for several seconds, the back light unit holds the frequency of the inverter driving signal and the frequency of the inverter driving signal varies smoothly in response to the display mode.

16 Claims, 6 Drawing Sheets

DISPLAY APPARATUS CAPABLE OF CHANGING DIMMING FREQUENCY OF BACK LIGHT AND CONTROL METHOD THEREOF

CROSS REFERENCE TO RELATED APPLICATION

This application claims priority from and the benefit of Korean Patent Application No. 10-2008-0133683, filed on Dec. 24, 2008, which is hereby incorporated by reference for all purposes as if fully set forth herein.

BACKGROUND OF THE INVENTION

1. Field of the Invention

The present invention relates to a display apparatus that synchronizes a synchronous signal and an inverter driving signal in response to a display mode, and a control method thereof.

2. Discussion of the Background

Flat panel displays such as an organic light emitting device (OLED), a plasma display panel (PDP), and a liquid crystal display (LCD) have been actively developed as substitutes for the cathode ray tube (CRT), which may be heavy and large.

A PDP is a device that displays characters or images using plasma generated by a gas-discharge, and an OLED is a device that displays characters or images using electroluminescence of a specific organic material or high molecular weight polymeric compounds. An LCD displays desired images by applying an electric field to a liquid crystal (LC) layer disposed between two panels and regulating the strength of the electric field to adjust the transmittance of light passing through the LC layer.

Among such flat panel displays, the LCD and the OLED may each include a display panel provided with pixels including switching elements and display signal lines, a gate driver for providing gate signals to gate lines among the display signal lines to turn on/off the switching elements of the pixels, a gray voltage generator for generating a plurality of gray voltages, a data driver for selecting a voltage corresponding to image data as a data voltage from the gray voltages and applying the data voltage to a data line among the display signal lines, and a signal controller for controlling the above elements. Each driver may be supplied with necessary predetermined voltages and convert them into various voltages to drive the display device. For example, the gate driver may receive a gate-on voltage and a gate-off voltage and alternately apply them to the gate line as a gate signal, and a gray voltage generator may receive a uniform reference voltage and divide it through a plurality of resistors to provide divided voltages to a data driver.

The LCD includes a liquid crystal to display an image, a backlight unit to emit light to the liquid crystal and an inverter to supply a current to the backlight unit.

A thin film transistor (TFT) LCD includes a plurality of pixels that includes a switching element such as an amorphous silicon (a-si) TFT or poly-crystalline silicon (p-si) TFT and a liquid crystal (LC) capacitor.

An a-Si TFT includes a gate electrode, a drain electrode, a source electrode, and a channel, which includes an a-si layer as a passage of electrical carriers from the source electrode to the drain electrode.

The a-Si used in a TFT LCD is sensitive to light. That is, an a-Si TFT becomes conductive and a resistance is reduced when receiving light. When the light is removed, the a-Si TFT becomes semi-conductive and a resistance rises relatively to be affected by a charging voltage of a liquid crystal capacitor. When light is emitted to the a-Si TFT, an overall parasitic capacity of data lines may be changed and a screen noise may be created.

When the backlight unit emits light consistently, a liquid crystal panel receives light uniformly, which does not trigger any problem. However, a problem may arise when brightness of the backlight unit is adjusted by pulse-width modulation (PWM), which involves turning on and off the backlight unit periodically to improve display quality.

When a frequency ratio of a synchronous signal and a PWM signal do not synchronized, regular movement of lines may be found in each frame, which is called waterfall noise.

Thus, display apparatuses have recently employed a synchronous inverter to synchronize the frequency of the synchronous signal and the PWM frequency, i.e., an inverter driving signal, at a proper ratio that may minimize such a noise. The currently employed synchronization is based on a horizontal synchronous signal Hsync synchronized on the basis of a horizontal line time clock or based on a vertical synchronous signal Vsync synchronized on the basis of a frame time.

The PWM frequency may be synchronized by multiplying a/b by a frequency of the horizontal synchronous signal HSYNC, or the PWM frequency may be synchronized by multiplying c/d by a frequency of the vertical synchronous signal VSYNC The multiplication numbers may be inputted as a numerator and a denominator to be multiplied. The multiplication numbers may be properly determined during a manufacturing stage of the display apparatus.

An LCD displays images of various modes in turn, such as a TV mode and a personal computer (PC) mode. When the LCD displays images of the TV mode, images of a high frame frequency, e.g. 120 Hz, may be required to provide smooth moving pictures to viewers because TV shows rapid movements of objects. When the LCD displays images of the PC mode, images of a low frame frequency, e.g. 60 Hz, may be required, because the PC monitor shows more fixed images than moving images.

When the frame frequency varies according to the display modes, the frequency of the vertical synchronous signal may also vary in response to the frame frequency and may be multiplied by the predetermined multiplication number to make the synchronous waveform to minimize waterfall noise.

However, the frequency of the vertical synchronous signal may abnormally vary for several seconds. The abnormal variation of the frequency of the vertical synchronous signal may result in an undesired PWM signal frequency.

SUMMARY OF THE INVENTION

The present invention provides a display apparatus to reduce synchronization errors of a synchronous signal and an inverter driving signal in response to a display mode, and a control method thereof.

Additional features of the invention will be set forth in the description which follows, and in part will be apparent from the description, or may be learned by practice of the invention.

The present invention discloses a display apparatus including a display panel to display an image thereon; and a back light unit to emit light to the display panel, a back light unit dimming frequency to vary based on a synchronous signal frequency of the image.

The present invention also discloses a back light unit for a display apparatus including a back light to receive a power and to emit a light; an inverter to supply the power to the back light in response to an inverter driving signal; a driving signal generator to generate an inverter driving signal having a frequency that is decided by multiplying a synchronous signal frequency of the image by a ratio; and a controller to recognize the synchronous signal frequency of the image and to control the driving signal generator by a control signal.

The present invention also discloses a control method of a display apparatus. The method includes generating an inverter driving signal i having a frequency that is decided by multiplying a synchronous signal frequency of an image by a ratio, the inverter driving signal to vary after a number of frames based on the synchronous signal frequency of the image. The method for generating the inverter driving signal further includes counting a vertical count value for at least one frame, the vertical count value being a length of one period of a synchronization signal based on a number of periods of a count clock including a period; comparing the vertical count value of a previous frame and a current frame from a mode counter, and registered vertical count value; calculating a sync counter value based on the comparison result of the vertical count value of the previous frame and the current frame from the mode counter, and registered vertical count value; and changing the inverter driving signal frequency in response to the sync counter value.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention, and together with the description serve to explain the principles of the invention.

DETAILED DESCRIPTION OF THE ILLUSTRATED EMBODIMENTS

Figure 1:
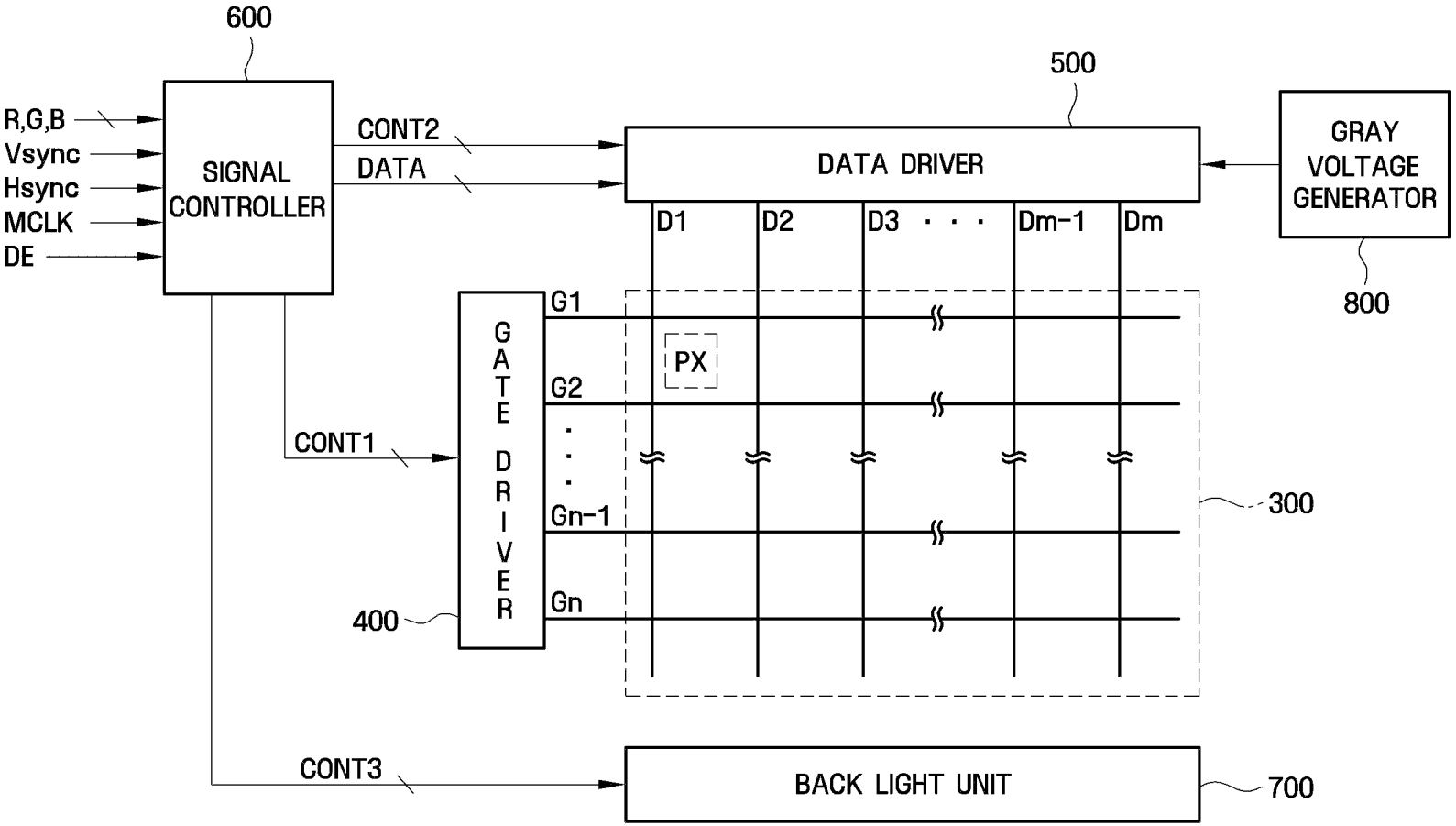
FIG. 1 is a block diagram of a liquid crystal display according to an exemplary embodiment of the present invention.

The invention is described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure is thorough, and will fully convey the scope of the invention to those skilled in the art. In the drawings, the size and relative sizes of layers and regions may be exaggerated for clarity. Like reference numerals in the drawings denote like elements.

It will be understood that when an element or layer is referred to as being "on" or "connected to" another element or layer, it can be directly on or directly connected to the other element or layer, or intervening elements or layers may be present. In contrast, when an element is referred to as being "directly on" or "directly connected to" another element or layer, there are no intervening elements or layers present.

A liquid crystal display according to an exemplary embodiment of the present invention will be described below in detail with reference to FIG. 1 and FIG. 2.

Figure 2:
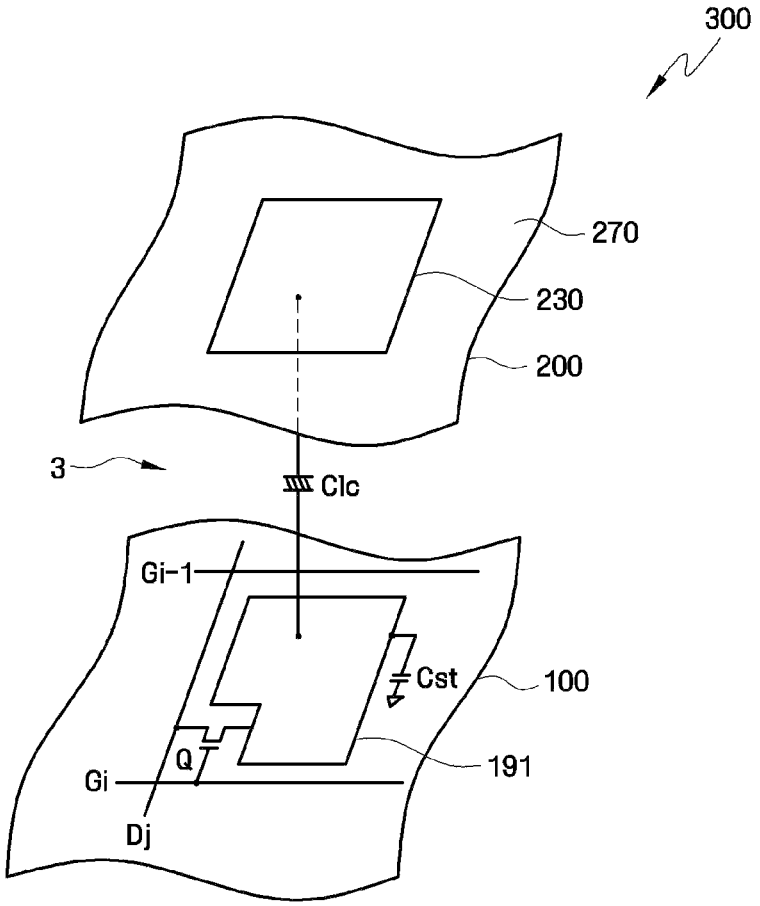
FIG. 2 is an equivalent circuit diagram of one pixel in the liquid crystal display according to an exemplary embodiment of the present invention.

FIG. 1 is a block diagram of a liquid crystal display according to an exemplary embodiment of the present invention, and FIG. 2 is an equivalent circuit diagram of one pixel in the liquid crystal display according to an exemplary embodiment of the present invention.

Referring to FIG. 1, a liquid crystal display according to an exemplary embodiment of the present invention includes a liquid crystal panel assembly 300, a gate driver 400, a data driver 500, a gray voltage generator 800, a signal controller 600, and a back light unit (BLU) 700.

Referring to FIG. 1, in an equivalent circuit, the liquid crystal panel assembly 300 includes a plurality of signal lines G1-Gn and D1-Dm, and a plurality of pixels PX that are connected to the plurality of signal lines G1-Gn and D1-Dm and are arranged in an approximate matrix shape. The signal lines D1-Dm include a plurality of data lines for delivering data signals, respectively. Referring to FIG. 2, the liquid crystal panel assembly 300 includes lower and upper substrates 100 and 200 that face each other, and a liquid crystal layer 3 disposed between the lower and upper substrates 100 and 200.

The signal lines G1 to Gn include a plurality of gate lines G1 to Gn for delivering gate signals respectively(also referred to as scan signals). The gate lines G1 to Gn extend in a first direction and are substantially parallel to each other, and the data lines D1 to Dm extend in a second direction and are substantially parallel to each other.

Each pixel, for example a pixel PX, includes a switching device Q connected to one of the gate lines and one of the data lines, a liquid crystal capacitor Clc that is connected to the switching device Q, and a storage capacitor Cst. The storage capacitor Cst may be omitted.

The switching element Q is a three-electrode element disposed on the lower substrate 100, such as a thin film transistor. In the switching device Q, a gate electrode is connected to the one of the gate lines, a source electrode is connected to the one of the data lines, and a drain electrode is connected to the liquid crystal capacitor Clc and the storage capacitor Cst.

The liquid crystal capacitor Clc has a pixel electrode 191 of the lower substrate 100 and a common electrode 270 of the upper substrate as two terminals, and the liquid crystal layer 3 between the two electrodes 191 and 270 as a function of a dielectric. The pixel electrode 191 is connected to the switching device Q. The common electrode 270 is formed on the whole surface of the upper display panel 200, and a common voltage Vcom is applied to the common electrode 270. Alternatively, the common electrode 270 may be included in the lower substrate 100, different from what is shown in FIG. 2.*In* that alternative embodiment, at least one of the two electrodes 191 and 270 may be formed in a shape of a line or a bar.

The storage capacitor Cst, which serves as an auxiliary to the liquid crystal capacitor Clc, is formed as a separate signal line (not shown) provided on the lower substrate 100 and the pixel electrode 191 overlap each other, with an insulator disposed therebetween. A predetermined voltage such as the common voltage Vcom or the like is applied to the separate signal line. Alternatively, the storage capacitor Cst may be formed by overlapping the pixel electrode 191 with the immediate previous gate line G(i-1) with the insulator disposed therebetween.

To realize a color display, the each pixel PX specifically displays one of the primary colors (spatial division), or the each pixel PX alternately display the primary colors over time (temporal division), which causes the primary colors to be spatially or temporally synthesized, thereby displaying a desired color. An example of the primary colors is three primary colors including red, green, and blue. FIG. 2 is an example of spatial division. As shown in the figure, the each pixel PX includes a color filter 230 representing one of the primary colors and is disposed in a region of the upper substrate 200 corresponding to the pixel electrode 191. Alternatively, the color filter 230 may be formed on the lower substrate 100 and above or below the pixel electrode 191.

At least one polarizer (not shown) for polarizing light is attached to an outer surface of the liquid crystal panel assembly 300.

Referring to FIG. 1 again, the gray voltage generator 800 may generate all the gray voltages or a limited number of gray voltages (hereinafter referred to as "reference gray voltages") related to the transmittance of the each pixel PX. The (reference) gray voltages may include gray voltages that have a positive value and gray voltages that have a negative value with respect to the common voltage Vcom.

The gate driver 400 is connected to the gate lines G1-Gn of the display panel assembly 300 and synthesizes a gate-on voltage Von and a gate-off voltage Voff to generate gate signals, which are applied to the gate lines G1-Gn.

The data driver 500 is connected to the data lines D1-Dm of the display panel assembly 300, and selects gray voltages supplied from the gray voltage generator 800 and then applies the selected gray voltages to the data lines D1-Dm as data voltages. However, in a case when the gray voltage generator 800 supplies only a limited number of reference gray voltages rather than supplying all gray voltages, the data driver 500 divides the reference gray voltages to generate desired data voltages. The data driver 500 according to an exemplary embodiment of the present invention receives image signals DATA from the signal controller 600. The data driver 500 is connected to the corresponding data lines, and applies data voltages to the corresponding data lines. The data driver 500 applies the data voltages to the data lines according to a control signal CONT2 that is transmitted to the data driver 500 from the signal controller 600, and accordingly the data voltages may be transmitted to the each pixel PX.

The back light unit 700 according to an exemplary embodiment of the present invention receives a control signal CONT3 from the signal controller 600 and emits light toward the liquid crystal panel assembly 300, particularly the plurality of pixels PX. The light emitted from the back light unit 700 passes through the liquid crystal layer 3 of the each pixel PX. The transmittance of the liquid crystal molecules in the liquid crystal layer 3 varies in response to electric fields imposed on the liquid crystal molecules.

Each of the driving circuits 400, 500, 600, and 800 may be directly mounted as at least one integrated circuit (IC) chip on the panel assembly 300 or on a flexible printed circuit film (not shown) in a tape carrier package (TCP) type, which are attached to the LC panel assembly 300, or may be mounted on a separated printed circuit board (not shown). Alternatively, the driving circuits 400, 500, 600, and 800 may be integrated on the panel assembly 300 along with the signal lines G1-Gn and D1-Dm and the TFT switching elements Q. Further, the driving circuits 400, 500, 600, and 800 may be integrated as a single chip. In this case, at least one driving circuit or at least one circuit device constituting a driving circuit may be located outside the single chip.

The operation of the above-described LCD will be explained in detail below.

The signal controller 600 is supplied with input image signals R, G, and B and input control signals for controlling the display thereof from an external graphics controller (not shown). The input image signals R, G, and B contain luminance information of the each pixel PX. The input control signals include, for example, a vertical synchronous signal Vsync, a horizontal synchronous signal Hsync, a main clock signal MCLK, and a data enable signal DE.

The signal controller 600 processes the input image signals R, G, and B in such a way to be suitable for the operating conditions of the liquid crystal panel assembly 300 based on the input image signals R, G, and B and the input control signal. The signal controller 600 generates a plurality of image signals DATA, a gate control signal CONT1, a data control signal CONT2, and so on, and the signal controller 600 transmit the gate control signal CONT1 to the gate driver 400, and the data control signal CONT2 and the processed image signals DATA to the data driver 500.

The gate control signal CONT1 includes a scan start signal STV for indicating scan start, and at least one clock signal for controlling an output period of the gate-on voltage Von. The gate control signal CONT1 may further include an output enable signal OE for limiting a time duration of the gate-on voltage Von.

The data control signal CONT2 includes a horizontal synchronization start signal STH for indicating initiation of data transmission of the image signals DATA to the data driver 500 for a row (group) of the pixels PX, a load signal LOAD for requesting the application of analog data voltages to the data lines D1 to Dm, and a data clock signal HCLK. The data control signal CONT2 may further include a reverse signal RVS for inverting voltage polarity of the data signal with respect to the common voltage Vcom (hereinafter, "voltage polarity of the data signal with respect to the common voltage" is abbreviated to "polarity of the data signal").

The gate driver 400 applies a gate-on voltage Von to the gate lines G1 to Gn according to the gate control signal CONT1 transmitted from the signal controller 600 to turn on switching devices Q connected to the gate lines G1 to Gn, and then the data signals applied to the data lines D1 to Dm are applied to corresponding pixels PX through the turned-on switching devices Q.

A difference between each of the data voltages applied to the each pixel PX and the common voltage Vcom appears as a charged voltage of the liquid crystal capacitor Clc, that is, a pixel voltage. Alignment of the liquid crystal molecules varies according to the magnitude of the pixel voltage to change the polarization of light from the back light unit 700 passing through the liquid crystal layer 3. The transmittance of light is changed by a polarizer attached to the liquid crystal panel assembly 300 according to the change in the polarization such that the pixels PX display a luminance corresponding to the grays of the image signals DATA.

In units of one horizontal period, which may be written as "1H" and is the same as one period of the horizontal synchronization signal Hsync and the data enable signal DE, the aforementioned operations are repeatedly performed to sequentially apply the gate-on voltages Von to all the gate lines G1 to Gn, so that the data signals are applied to all the pixels PX. As a result, one frame of the image may be displayed. When one frame ends, the next frame starts, and a state of the reverse signal RVS applied to the data driver 500 is controlled so that polarities of the data signals applied to each of the pixels is opposite to the polarities in the previous frame (frame inversion). At this time, even in one frame, according to the characteristics of the reverse signals RVS, the polarity of the data signal flowing through one data line may be inverted (row inversion and dot inversion). In addition, the polarities of the data signals applied to one pixel row may be different from each other (column inversion and dot inversion).

Figure 3:
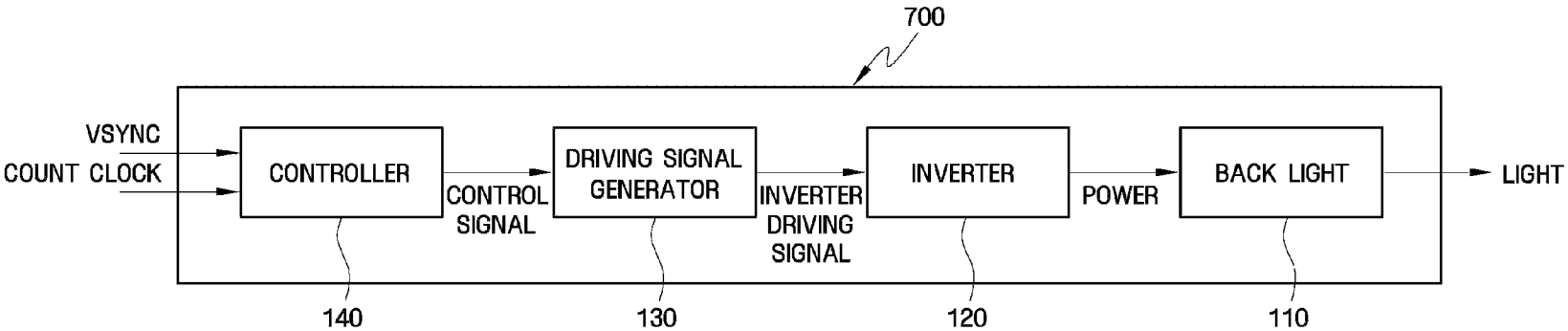
FIG. 3 is a block diagram of a back light unit according to an exemplary embodiment of the present invention.

FIG. 3 is a block diagram of a back light unit 700 according to an exemplary embodiment of the present invention. The back light unit 700 according to the exemplary embodiment of the present invention includes a backlight 110 to emit light to a liquid crystal layer 3 and an inverter to supply a current to the backlight 110. The back light unit 700 may synchronize a synchronous signal and an inverter driving signal. For example, the back light unit 700 may be used in an LCD (liquid crystal display) TV, a monitor, and the like.

As shown therein, the back light unit 700 includes a back light 110, an inverter 120, a driving signal generator 130, and a controller 140.

The back light 110 emits light to the liquid crystal panel (not shown). The backlight 110 may include a plurality of lighting elements such as light emitting diode (LED), a cold cathode fluorescent lamp (CCFL), an hot cathode fluorescent lamp (HCFL), and the like.

The inverter 120 supplies power to the back light 110 according to the inverter driving signal. More specifically, the inverter 120 supplies power to the back light 110 according to the inverter driving signal having a predetermined duty ratio as a method of pulse width modulation. For example, the inverter 120 may include a plurality of switches (not shown) and turn on and off the plurality of switches according to the inputted inverter driving signal to supply power to the back light.

The driving signal generator 130 generates the inverter driving signal which has a frequency multiplied by a predetermined ratio from a frequency of a synchronous signal The synchronous signal may include a horizontal synchronous signal HSYNC or a vertical synchronous signal VSYNC.

More specifically, the driving signal generator 130 generates an pulse width modulation (PWM) inverter driving signal to turn on and off the backlight unit periodically. The driving signal generator 130 synchronizes the frequency of the synchronous signal and the PWM frequency, i.e., a frequency of an inverter driving signal, at a predetermined ratio. For example, the inverter driving signal have a frequency which is 5/2 multiplied by the vertical synchronous signal.

The controller 140 controls the driving signal generator 130 which outputs the inverter driving signal according to a display mode. More specifically, the controller 140 controls the driving signal generator 130 to adjust frequencies of the plurality of inverter driving signals based on the frame rate of image. The controller 140 receives a control signal CONT3 as shown in FIG. 1. The control signal CONT3 may include, for example, a vertical synchronous signal Vsync, a horizontal synchronous signal Hsync, and a count clock.

Figure 4:
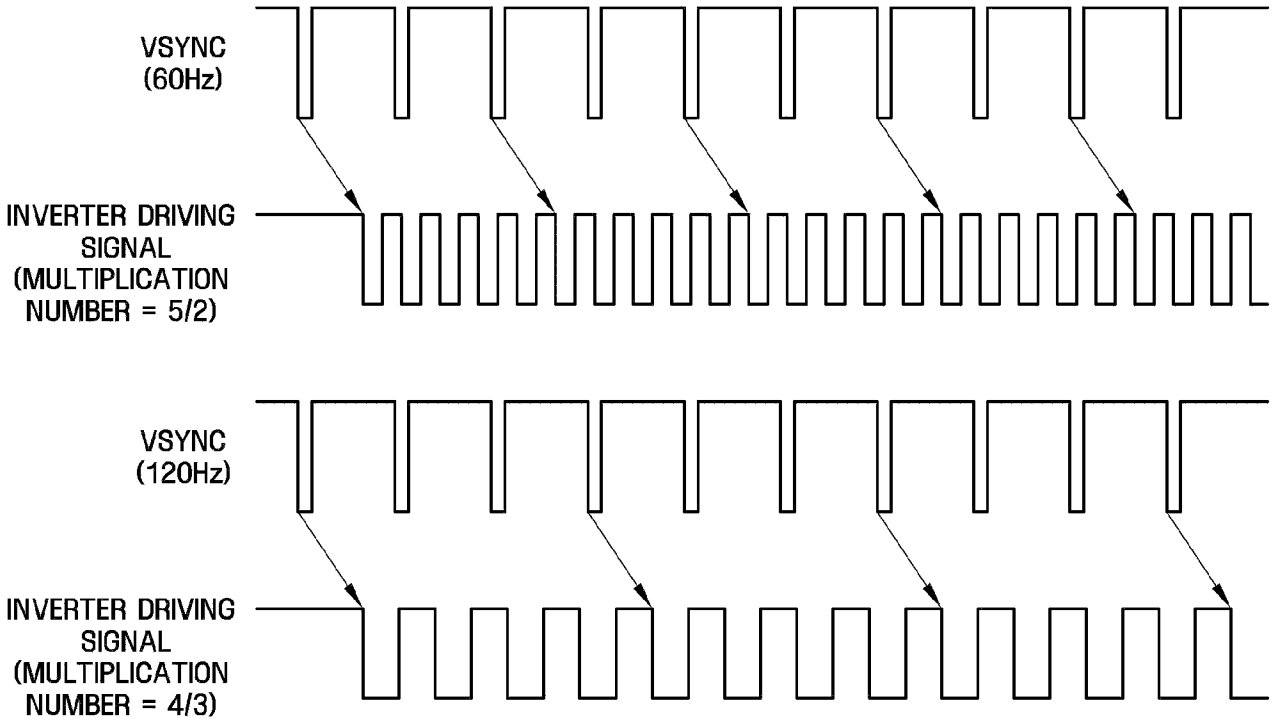
FIG. 4 shows a timing of an inverter driving signal with respect to a synchronous signal.

As shown in FIG. 4, the frequency of the vertical synchronous signal VSYNC varies according to display modes. When an LCD panel displays images as a TV, a frame rate of images is 120 Hz and the frequency of the vertical synchronous signal VSYNC is also 120 Hz. When the suitable PWM frequency of the back light 110 is from 150 Hz to 160 Hz, an inverter driving signal of 160 Hz can be obtained by multiplication of 4/3 to the vertical synchronous signal VSYNC of 120 Hz.

When an LCD panel displays images as a monitor for a personal computer (PC), a frame rate of images is 60 Hz and the frequency of the vertical synchronous signal VSYNC is also 60 Hz. When the suitable PWM frequency of the back light 110 is from 150 Hz to 160 Hz, an inverter driving signal of 150 Hz can be obtained by multiplication of 5/2 to the vertical synchronous signal VSYNC of 60 Hz. The multiplication numbers may be inputted as a numerator and a denominator to be multiplied. The multiplication numbers may be stored in a register at a manufacturing stage of the display apparatus and also be selected according to the display mode during display operation.

Figure 5:
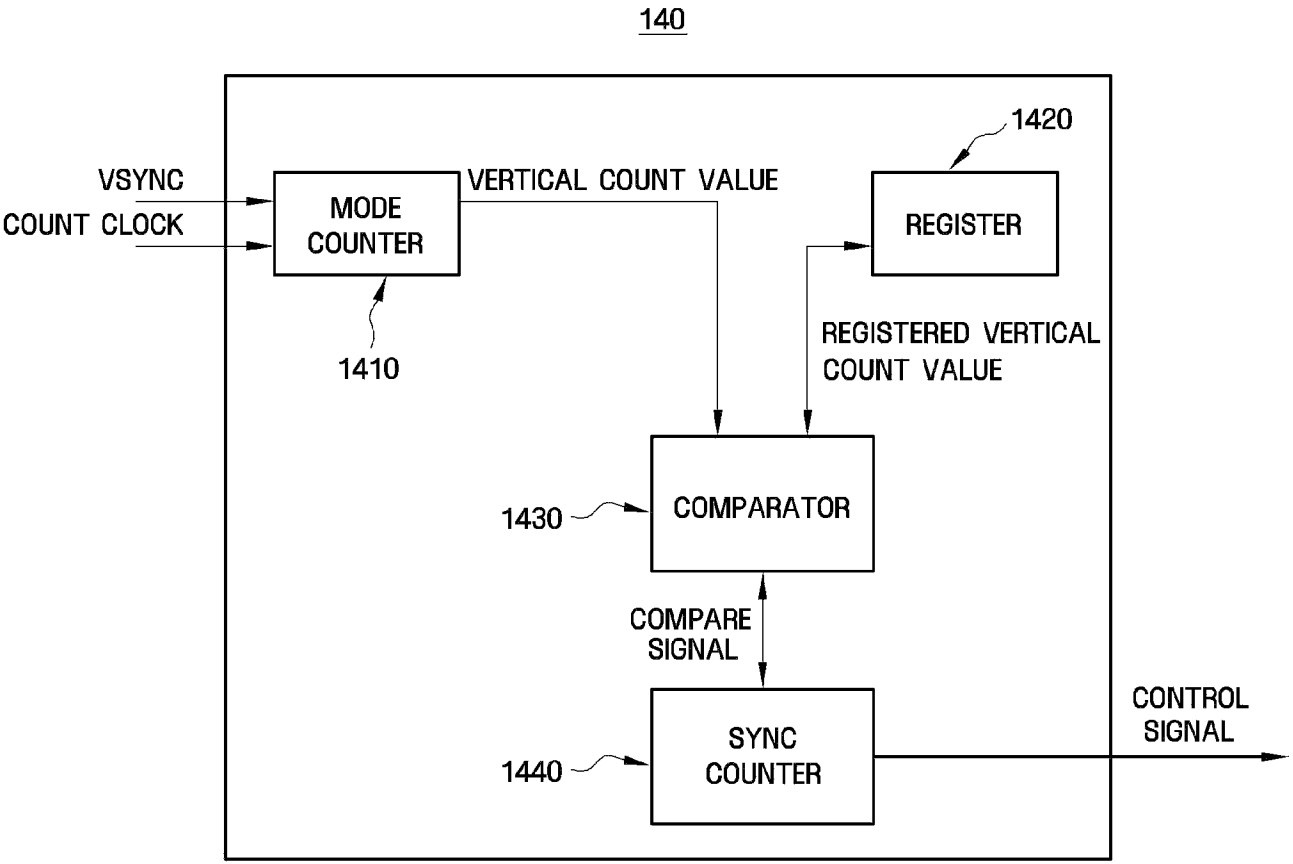
FIG. 5 is a block diagram of a sync counter according to an exemplary embodiment of the present invention.

FIG. 5 is a block diagram of the controller 140 according to the exemplary embodiment of the present invention.

As shown therein, the controller 140 includes a mode counter 1410, a register 1420, a comparator 1430, and a sync counter 1440.

The mode counter 1410 receives the vertical synchronization signal and the count clock having a predetermined period from the signal controller (not shown), and transmits a vertical count value to the comparator 1430.

The register 1420 stores the registered vertical count value and transmits the registered vertical count value to the comparator 1430.

The comparator 1430 receives the vertical count value from the mode counter 1410 and the registered vertical count value from the register 1420, and transmits a compare signal to the sync counter 1440.

The sync counter 1440 receives the compare signal from the comparator 1430, and transmits a control signal to the driving signal generator (not shown).

Figure 6:
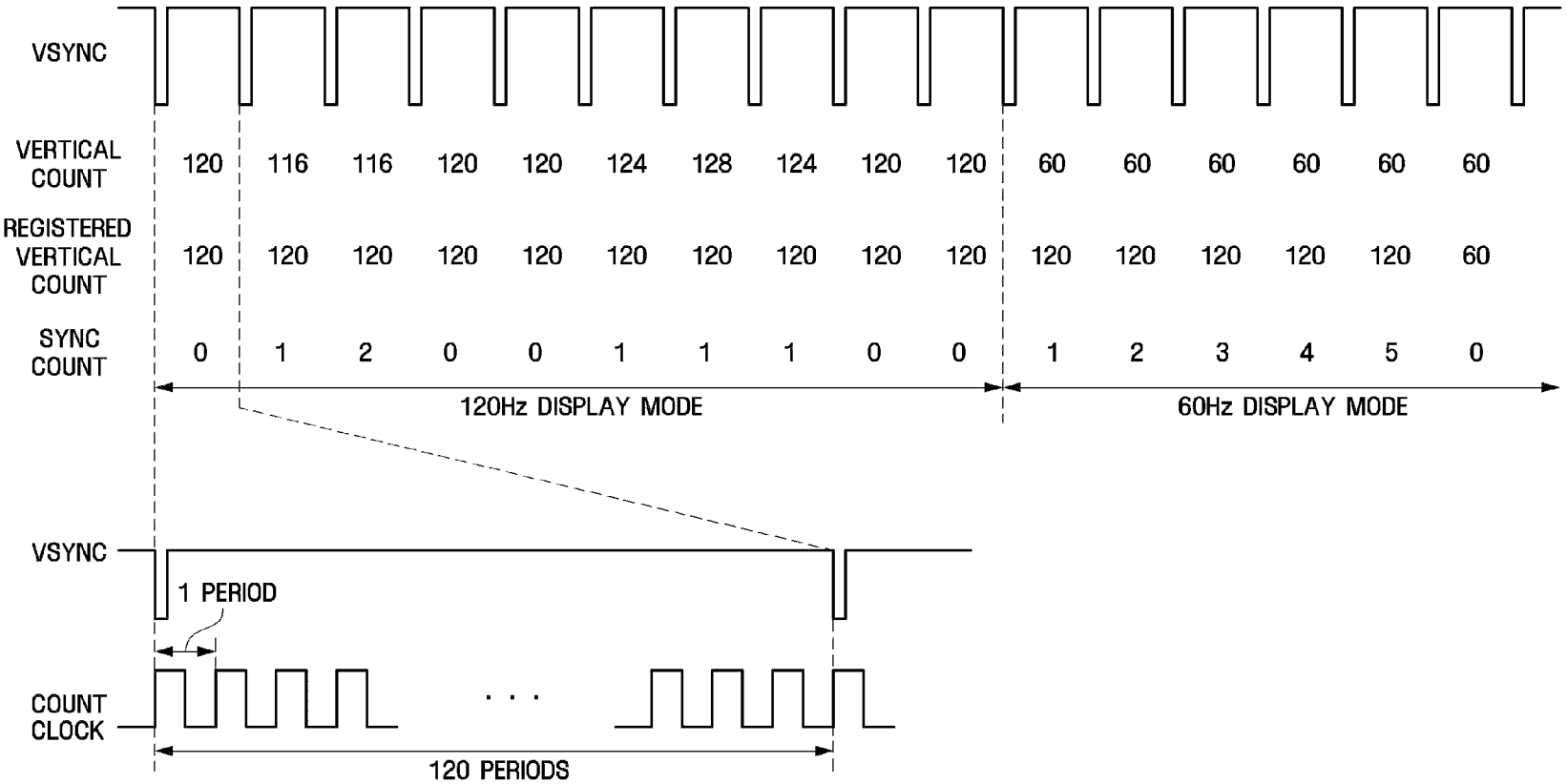
FIG. 6 shows a timing of a sync counter value with respect to a synchronous signal.

The operation of the above-described controller 140 will be explained in detail below, referring FIG. 5 and FIG. 6.

The mode counter 1410 receives the vertical synchronization signal VSYNC and the COUNT CLOCK having a predetermined period from the signal controller (not shown). The mode counter 1410 counts the length of one period of vertical synchronization signal VSYNC in terms of a number of periods of the count clock. When the frequency of the vertical synchronization signal VSYNC is 120 Hz and the frequency of the count clock is 14400 Hz, the length of the one period of the vertical synchronization signal VSYNC is same as 120 periods of the count clock, and the vertical count value is 120.

The register 1420 stores the registered vertical count value for the current display mode and transmits the registered vertical count value to the comparator 1430.

The comparator 1430 receives the vertical count values of a previous frame and a current frame from the mode counter 1410 and the registered vertical count value from the register 1420. When the vertical count value of the current frame is the same as the registered vertical count value, the comparator sends the compare signal that indicates the vertical count value and the registered vertical count value are the same. The sync counter 1440 receives the compare signal which indicates the vertical count value and the registered vertical count value are the same and a sync counter value is held as zero or reset to zero.

When the vertical count value of a current frame is different from the registered vertical count value, the comparator next verifies that the sync counter value is zero and compares the vertical count value of a previous frame and the vertical count value of the current frame.

When the sync counter value is zero and the vertical count value of the previous frame and the vertical count value of the current frame are different, the sync counter value is increased by one.

When the sync counter value is not zero and the vertical count value of the previous frame and the vertical count value of the current frame are different, the sync counter value holds a current value.

When the vertical count value is different from the registered vertical count value and the vertical count value of the previous frame and the vertical count value of the current frame are the same, the sync counter value is increased by one. When the sync counter value becomes the same as a predetermined frame number, the sync counter 1440 recognize that the display mode is changed and sends the control signal to the driving signal generator 130 (not shown) to change the frequency of the inverter driving signal according to the vertical count value. The registered vertical count value is also updated to the vertical count value.

When the vertical synchronous signal VSYNC having an abnormal frequency is inputted to the controller for several seconds, the sync counter 1440 holds the frequency of the inverter driving signal.

As described above, the present invention provides a display apparatus which may reduce synchronization errors of a synchronous signal and an inverter driving signal, and a control method thereof.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A display apparatus, comprising:

a display panel to display an image according to a synchronous signal; and a back light unit to emit a light to the display panel, wherein the back light unit comprises a controller to determine a first number of frames during which a change in a frequency of the synchronous signal is maintained, determine whether the first number of frames has reached a first threshold value, and recognize a change of display mode of the display apparatus from a first mode to a second mode when the first number has reached the first threshold value, wherein the controller comprises:

a mode counter to receive the synchronous signal and a count clock comprising a period from an exterior source, the mode counter to transmit a vertical count value of a frame;

a register to store a registered vertical count value;

a comparator to receive the vertical count value of a previous frame and a current frame from the mode counter and the registered vertical count value from the register, the comparator to transmit a compare signal; and a sync counter to receive the compare signal from the comparator and to transmit the control signal to the driving signal generator, wherein the sync counter is configured to hold a sync counter value at zero or reset to zero when the sync counter receives the compare signal, and the compare signal indicates the vertical count value of the current frame and the registered vertical count value are the same, wherein the sync counter is further configured to increase the sync counter value by one when the vertical count value of the current frame is different from the registered vertical count value and the sync counter value is zero at the previous frame, or when the vertical count value of the current frame is different from the registered vertical count value and the vertical count value of the previous frame and the vertical count value of the current frame are the same, and wherein the sync counter is further configured to hold the sync counter value at a current value when the sync counter value at the previous frame is not zero and the vertical count value of the previous frame and the vertical count value of the current frame are different.

2. The display apparatus of claim 1, the back light unit further comprising;

a back light emitter to receive a power and to emit the light;

an inverter to supply the power to the back light emitter in response to an inverter driving signal; and a driving signal generator configured to generate the inverter driving signal to control the light, wherein the inverter driving signal has a frequency equal to a ratio multiplied by the frequency of the synchronous signal, wherein the controller is configured to recognize the change of the frequency of the synchronous signal, and to output a control signal indicative of a change of a display mode of the display apparatus to the driving signal generator in response to the determination that the first number of frames has reached the first threshold value, and wherein the back light emitter dims the light based on the inverter driving signal.

3. The display apparatus of claim 2, wherein the driving signal generator is configured to change the frequency of the inverter driving signal in response to the control signal indicative of the change of the display mode of the display apparatus.

4. The display apparatus of claim 2, wherein the synchronous signal is one of a horizontal synchronous signal and a vertical synchronous signal.

5. The display apparatus of claim 3, wherein the vertical count value of the frame is a length of one period of the synchronous signal, the length of one period being based on a number of the count clock periods.

6. The display apparatus of claim 5, wherein the sync counter determines that the frequency of the synchronous signal is changed and sends the control signal to the driving signal generator to change the frequency of the inverter driving signal as the changed frequency of the synchronous signal multiplied by the ratio, when the sync counter value becomes the same as a predetermined number.

7. The display apparatus of claim 6, wherein the registered vertical count value is updated to the current vertical count value, when the sync counter sends the control signal to the driving signal generator to change the frequency of the inverter driving signal.

8. A back light unit for a display apparatus, comprising:

a back light emitter to receive a power and to emit a light;

an inverter to supply the power to the back light emitter in response to an inverter driving signal;

a driving signal generator to generate the inverter driving signal having a frequency equal to a ratio multiplied by a frequency of a synchronous signal; and a controller to recognize a change in the frequency of the synchronous signal and to determine a first number of frames during which the change in the frequency of the synchronous signal is maintained, wherein the controller is configured to determine whether the first number of frames has reached a first threshold value, and to output a control signal indicative of a change of a display mode of the display apparatus from a first mode to a second mode to the driving signal generator in response to the determination that the first number of frames has reached the first threshold value, wherein the controller comprises:

a mode counter to receive the synchronous signal and a count clock comprising a period from an exterior source, the mode counter to transmit a vertical count value of a frame;

a register to store a registered vertical count value;

a comparator to receive the vertical count value of a previous frame and a current frame from the mode counter, the registered vertical count value from the register, and to transmit a compare signal; and a sync counter to receive the compare signal from the comparator and to transmit the control signal to the driving signal generator, wherein the sync counter is configured to hold a sync counter value at zero or reset to zero when the sync counter receives the compare signal, the compare signal indicates the vertical count value of the current frame and the registered vertical count value are the same, wherein the sync counter is further configured to increase the sync counter value by one when the vertical count value of the current frame is different from the registered vertical count value and the sync counter value is zero at the previous frame, or when the vertical count value of the current frame is different from the registered vertical count value and the vertical count value of the previous frame and the vertical count value of the current frame are the same, and wherein the sync counter is further configured to hold the sync counter value at a current value when the sync counter value is not zero and the vertical count value of the previous frame and the vertical count value of the current frame are different.

9. The back light unit of claim 8, wherein the driving signal generator is configured to change the frequency of the inverter driving signal in response to the control signal indicative of the change of the display mode of the display apparatus.

10. The display apparatus of claim 8, wherein the synchronous signal is one of a horizontal synchronous signal and a vertical synchronous signal.

11. The back light unit according to claim 9, wherein the vertical count value of the frame is a length of one period of the synchronous signal, the length of one period based on a number of the periods of the count clock.

12. The back light unit of claim 11, wherein when the sync counter value becomes the same as a predetermined number, the sync counter determines the frequency of the synchronous signal is changed and sends the control signal to the driving signal generator to change the frequency of the inverter driving signal as the changed frequency of the synchronous signal multiplied by the ratio.

13. The display apparatus of claim 12, wherein the registered vertical count value is updated to the current vertical count value, when the sync counter sends to the control signal to the driving signal generator to change the frequency of the inverter driving signal.

14. A control method of a display apparatus, the method comprising:

receiving a synchronous signal;

recognizing a change in a frequency of the synchronous signal;

determining a first number of frames during which the change in the frequency of the synchronous signal is maintained, determining whether the first number of frames has reached a first threshold value, and recognizing a change of display mode of the display apparatus from a first mode to a second mode when the first number has reached the first threshold value; and generating an inverter driving signal, the inverter driving signal having a frequency equal to a ratio multiplied by a frequency of the synchronous signal, wherein the generating the inverter driving signal comprises:

counting a vertical count value for at least one frame, the vertical count value being a length of one period of the synchronous signal based on a number of periods of a count clock, comparing the vertical count value of a previous frame and a current frame and a registered vertical count value, calculating a sync counter value based on the comparison result of the vertical count value of the previous frame, the current frame, and the registered vertical count value, and changing the frequency of the inverter driving signal based on the sync counter value, and wherein the calculating the sync counter value comprises:

holding the sync counter value at zero or resetting to zero when the vertical count value of the current frame and the registered vertical count value are the same, increasing the sync counter value by one when the vertical count value of the current frame is different from the registered vertical count value and the sync counter value is zero at the previous frame, or when the vertical count value of the current frame is different from the registered vertical count value and the vertical count value of the previous frame and the vertical count value of the current frame are the same, and holding the sync counter value at a current value when the sync counter value at the previous frame is not zero, and the vertical count value of the previous frame and the vertical count value of the current frame are different.

15. The method of claim 14, wherein the changing the frequency of the inverter driving signal comprises changing the frequency of the inverter driving signal as the changed frequency of the synchronous signal multiplied by the ratio when the sync counter value becomes the same as a predetermined number.

16. The method of claim 14, further comprising:

changing the frequency of the inverter driving signal in response to the determination that the first number of frames has reached the first threshold value; and dimming a back light based on the inverter driving signal.

* * * * *